United States Patent [19]

Howerton

[11] Patent Number: 5,046,978

[45] Date of Patent: Sep. 10, 1991

[54] FLOAT TUBE WITH ADJUSTABLE SLING SEAT

[76] Inventor: Larry L. Howerton, 2607 McKinney, Boise, Id. 83704

[21] Appl. No.: 558,756

[22] Filed: Jul. 26, 1990

[51] Int. Cl.[5] ..... B63C 9/08

[52] U.S. Cl. ..... 441/131; 114/345

[58] Field of Search ..... 114/345, 346, 363; 441/129, 130, 126, 67, 66; 297/459, 284

[56] References Cited

U.S. PATENT DOCUMENTS

| | | | |
|---|---|---|---|
| 2,075,374 | 3/1937 | Tucker | 441/131 |
| 2,246,108 | 6/1941 | Sermon | 441/131 |
| 2,529,961 | 11/1950 | Phillips | 441/131 |
| 2,958,876 | 11/1960 | Garrett | 441/131 |
| 4,613,311 | 9/1986 | Wood | 441/131 X |

FOREIGN PATENT DOCUMENTS

| | | | |
|---|---|---|---|
| 168002 | 6/1934 | Switzerland | 441/131 |

*Primary Examiner*—Ed Swinehart

*Attorney, Agent, or Firm*—Paul F. Horton

[57] ABSTRACT

A float tube device with adjustable sling seat, the float tube device having a buoyant annular tubular member; a flexible fabric cover encasing the tubular member; a laterally extending band of flexible material, extending across a central opening of the tubular member to define a sling seat; and adjustable belt members for selectively increasing or decreasing the sling of the seat. The adjustable belts can be adjusted to provide sufficient tension on the seat to provide a stiff seat or may be loosened to provide a desired amount of sling. A second pair of adjustable belt members allows for selected forward or rearward tilt or pitch of the seat to maximize comfort. The seat member is affixed directly to the cover for safety and a crotch strap may be provided as an additional safety feature and to assist in providing selective tilt under some conditions.

7 Claims, 1 Drawing Sheet

FLOAT TUBE WITH ADJUSTABLE SLING SEAT

BACKGROUND OF THE INVENTION

1. Field of the Invention

This invention relates, in general, to float tube devices, and, more particularly, to seat members therefore.

2. Description of the Prior Art

In float tubing, it is highly desirable to maximize comfort while providing necessary safety In that the float tube user is seated within the tube, the seat becomes a critical part of the float tube both as to safety and comfort.

U.S. Pat. No. 2,724,843, issued to B. J. Kimball, discloses a sling seat formed by two flexible bands strapped to a tube to criss-cross adjacent the center of the central opening defined by the tube No means of adjusting the straps are is provided.

U.S. Pat. No. 763,518, issued to A. Tann, and 1,190,743, issued to R. B. Fageol, show seat members affixed to tubular members by adjustable belts. Uncoupling of the belts would result in dumping the user into the water.

Likewise, U.S. Pat. No. 769,847, issued to A. Tann and U.S. Pat. No. 2,958,876, issued to C. V. Garrett, show seats attached to tubular members by adjustable belt members.

Lacking in the above devices are flexible sling seats which are attached directly to the tube cover for safety and which may also be adjusted for a selected degree of sling and tilt.

SUMMARY OF THE INVENTION

The present invention overcomes these problems by providing a float tube device having a flexible and collapsible annular tubular member; a cover member encasing the tubular member; a lateral band of flexible material extending across the central opening of the device and securely fastened to opposing portions of the cover to define a sling seat; and adjustable belt members affixed to the seat and to the cover to provide selected tension on the seat to provide a seat which may be adjusted from board-like stiffness to a relatively deep sling; to provide a seat of desired tilt from front to back; and to provide a seat which cannot accidentally be unhooked from the tube cover and hence the tube. A crotch strap may be provided for additional safety and to assist in tilting under certain conditions.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
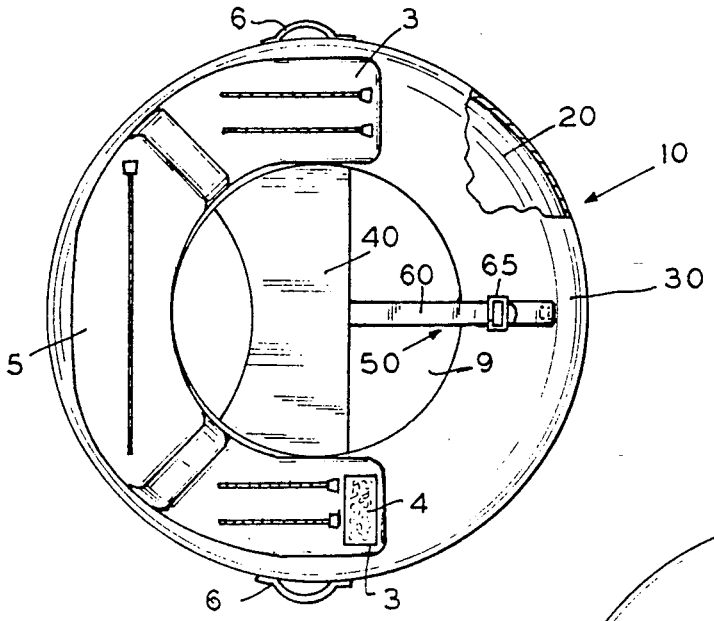
FIG. 1 is a plan view, in partial section, of a preferred embodiment of the float tube device of the present invention.

Referring now to the drawings, an embodiment to be preferred of a float tube device 10, made according to the present invention, is disclosed. Device 10 includes, generally, a buoyant tubular member 20; a cover member 30; a sling seat 40; and one or more adjustable belt members, designated generally by the numeral 50, for selective tensioning and tilting of the seat.

Buoyant tubular member 20 is preferably flexible and elastic, being made of rubber for ready inflating and deflating, and is commonly known as an "inner tube", being conventional in the art. The tube shown is annular in construction, defining a central opening 9. The tube may be circular in form, as is shown, or any other shape defining a central opening surrounded by the tubular member and "annular" is defined in this context.

Completely encasing tubular member 20 is flexible cover member 30, being constructed of any suitable fabric, as for example, Nylon. Tubular member 20 may be inserted and/or removed from cover 30 by means of a zipper, not shown. Cover 30, as shown in FIG. 1, may optionally include zippered receptacles 3, hook holders 4, a backrest 5, handles 6, an apron, not shown, and other accessories, not a part of the present invention.

Figure 3:
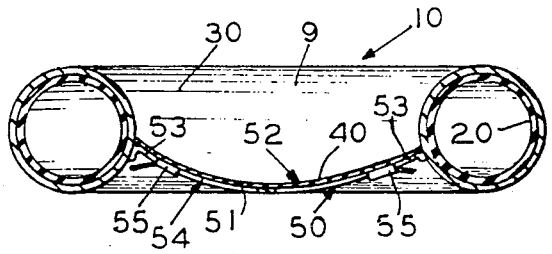
FIG. 3 is a sectional view taken along lines 3—3 of FIG. 2.

Extending laterally across central opening 9 and securely affixed to opposing facing surfaces of cover 30 is a band of flexible material, preferably Nylon mesh, defining seat 40. The length of the band is in excess of the distance between the opposing surfaces to which the band is attached so as to form a sling, serving as a seat for the float tube user, as shown to advantage in FIG. 3. In being securely affixed to the cover, by stitching 19, or otherwise, the seat cannot be uncoupled accidentally from the cover and hence from the buoyant tubular member 20, encased within the cover.

Figure 2:
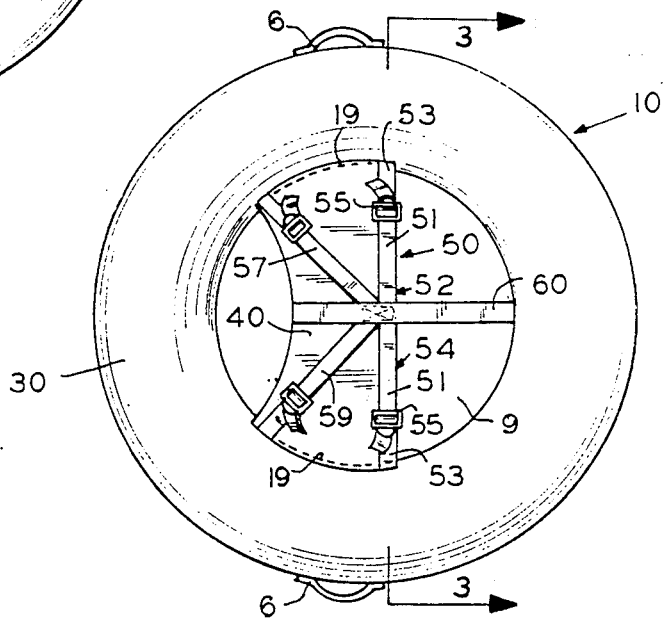
FIG. 2 is a bottom view of the device of FIG. 1.
Figure 4:
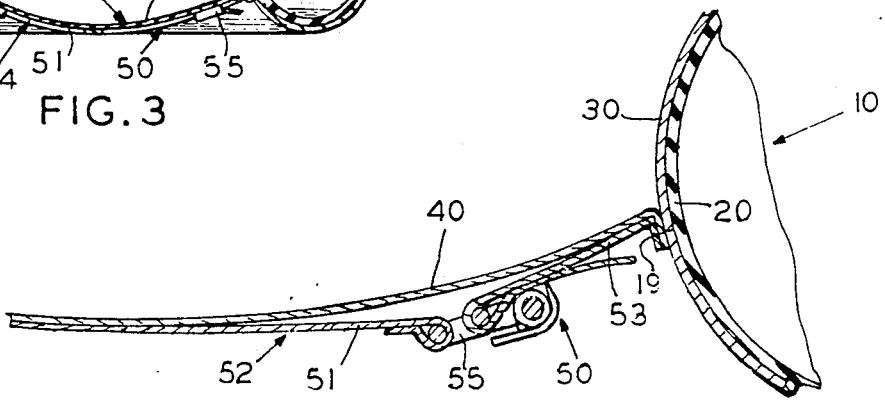
FIG. 4 is an enlarged partial sectional view of the sling seat together with one adjustable belt member.

Affixed to the bottom surface of seat 40 adjacent the lateral midpoint of the seat, as shown in FIG. 2 and to opposing sidewalls of cover 30 are a first pair of adjustable belt members, designated specifically by the numerals 52 and 54. Belt members 52 and 54 are preferably affixed, in lateral alignment, across the forwardmost portion of the seat. Each member includes a strap portion 51 affixed to the seat; a second strap 53, attached to the cover; and a buckle 55 for strap adjustment to provide a selected degree of slack or sling in the seat, as shown in FIG. 4.

In addition to the first pair of belt members, a second pair of belt members 157 and 59 may also be provided. Like the first pair of belt members, members 57 and 59 include a strap portion affixed to the seat 40 adjacent the lateral midpoint of the seat; a second strap affixed to the cover 30; and buckles for strap adjustment. Belt members 57 and 59, however, are affixed to the cover rearwardly of the first pair of belt members at an acute angle relative to respective belt members of the first pair, as shown in FIG. 2. Such placement allows for selective forward and rearward tilting of the seat 40, at various degrees of sling.

As a safety device, and also to assist in desired tilting of seat 40, an adjustable crotch belt 60 may be provided. Belt 60 is affixed to the bottom of the seat at the lateral midpoint of the seat, as seen in FIG. 2, and is affixed, at the opposing end, to the top outside surface of cover 30, as shown in FIG. 1, by stitching or the like. A buckle 65 takes up the slack in the belt, and, in so doing, tends to tilt the seat rearward. Such rearward tilt is only effective where the first pair of adjustable belts 52 and 54 are in a somewhat slack mode.

For use, first pair of belt members 52 and 54 are tightened to provide a desire sling to seat 40. The belt members may be tightened to provide a taut bench-like seat or may be selectively loosened to provide a sling of selected depth. Belt members 57 and 59 are then adjusted to provide a desired forward or backward tilt to the seat and crotch belt 60 is also adjusted for desired comfort. It is to be noted that such apparatus provides a seat that is safe in that it cannot be detached accidentally from the cover and hence the buoyant tubular member; that the seat may be adjusted from bench-like to deep sling comfort; and the seat may be tilted forward or rearward, as desired.

Having thus described in detail preferred embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A float tube device comprising:

a flexible buoyant tubular member, substantially annular in form and defining a central opening;

a flexible fabric annular cover member encasing said tubular member;

a lateral band of flexible material affixed to opposing portions of said cover member across the central opening; said band of flexible material having a length in excess of the distance between said opposing portions to define a seat with sling; and adjustable belt means across the width of said seat and connected to and between said seat and said cover for selectively adjusting the sling of said seat.

2. The device as described in claim 1 wherein said adjustable belt means includes a first pair of adjustable belt members, each belt member in lateral alignment with one another, each belt member affixed to said seat adjacent the lateral midpoint thereof, and each belt member affixed to an opposing portion of said cover member.

3. The device as described in claim 2 wherein said first pair of adjustable belt members are affixed to said seat and to said cover member adjacent the forwardmost end of said seat and further comprising a second pair of adjustable belt members affixed to said seat and connected to said cover member rearwardly of said first pair of belt members to provide selective tilt to said seat.

4. The device as described in claim 3 wherein each of said second pair of belt members are set at an acute angle relative to a respective belt member of said first pair of belt members.

5. The device as described in claim 1 further comprising an adjustable crotch belt member forwardly extending from said seat and connected to said cover to define two openings for positioning of a user's legs therethrough.

6. A float tube device comprising:

a buoyant tubular member, annular in shape to define a central opening;

a fabric cover member encasing said tubular member;

a lateral band of flexible material affixed to opposing portions of said cover member across the central opening, said band having a length in excess of the distance between said opposing portions to define a seat with sling;

a first pair of adjustable belt members in lateral alignment with one another and each of said belt members affixed to said cover member and to said seat at the substantial lateral midpoint thereof adjacent the forwardmost end of said seat for selective adjustment of the sling of said seat: and a second pair of adjustable belt members, each of said second belt members affixed to said seat at the lateral midpoint thereof and each of said second pair of belt members affixed to said cover rearwardly of and at an acute angle to a respective adjacent belt member of said first pair of belt members for selective adjustment of the tilt of said seat.

7. The device as described in claim 6 further comprising an adjustable crotch belt member forwardly extending from said seat and connected to said cover member.

* * * * *